US010076922B2

(12) United States Patent
Noizet et al.

(10) Patent No.: US 10,076,922 B2
(45) Date of Patent: Sep. 18, 2018

(54) CUSTOMIZABLE DOCUMENT FOR PRODUCING A SECURITY DOCUMENT, CUSTOMIZED SECURITY DOCUMENT AND PRODUCTION OF SUCH A SECURITY DOCUMENT

(71) Applicant: SURYS, Bussy Saint Georges (FR)

(72) Inventors: Alexandre Noizet, Bussy Saint Georges (FR); Valéry Petiton, Vendrest (FR)

(73) Assignee: SURYS, Bussy Saint Georges (FR)

( * ) Notice: Subject to any disclaimer, the term of this patent is extended or adjusted under 35 U.S.C. 154(b) by 0 days.

(21) Appl. No.: 15/037,973

(22) PCT Filed: Sep. 25, 2014

(86) PCT No.: PCT/EP2014/070458
§ 371 (c)(1),
(2) Date: May 24, 2017

(87) PCT Pub. No.: WO2015/074786
PCT Pub. Date: May 28, 2015

(65) Prior Publication Data

US 2018/0065397 A1 Mar. 8, 2018

(30) Foreign Application Priority Data

Nov. 19, 2013 (FR) ..... 13 61338

(51) Int. Cl.
*B42D 25/328* (2014.01)
*B42D 25/351* (2014.01)
(Continued)

(52) U.S. Cl.
CPC ..... *B42D 25/328* (2014.10); *B41M 3/14* (2013.01); *B41M 5/267* (2013.01);
(Continued)

(58) Field of Classification Search
CPC ..... G02B 5/008
(Continued)

(56) References Cited

U.S. PATENT DOCUMENTS

2003/0234292 A1* 12/2003 Jones ..... B41M 3/14 235/491
2005/0128590 A1 6/2005 Schilling et al.
(Continued)

FOREIGN PATENT DOCUMENTS

EP 1775142 A1 4/2007
EP 2238516 B1 4/2012
(Continued)

OTHER PUBLICATIONS

International Search Report issued in PCT/EP2014/070458 dated Jan. 9, 2015 (3 pages).
(Continued)

*Primary Examiner* — Kimberly N Kakalec
(74) *Attorney, Agent, or Firm* — Osha Liang LLP

(57) ABSTRACT

According to one aspect, the invention relates to a customizable document for producing a customized security document (10, 20). The customizable document includes, according to an alternative: a layer (12) which can be customized by contact-free writing an opaque customization mask that is transparent in at least one transparency area (121); a first multilayer film (102) arranged on a first side of the customizable layer (12), including a layer having a high refractive index and encapsulated between two layers having a low refractive index, and structured over at least a portion of the surface thereof such as to form a first subwavelength array, characterized by a first array vector, such that the first multilayer film acts at zero order as a wavelength subtractive filter; a second multilayer film (102) arranged on a second side of the customizable layer, opposite the first side, includ-
(Continued)

ing a layer having a high refractive index and encapsulated between two layers having a low refractive index, and structured over at least a portion of the surface thereof such as to form a second subwavelength array characterized by a second array vector, such that the second multilayer film acts at zero order as a wavelength subtractive filter, the first and second arrays being at least partially stacked.

14 Claims, 10 Drawing Sheets

(51) Int. Cl.
*B41M 5/26* (2006.01)
*B41M 3/14* (2006.01)
*B42D 25/435* (2014.01)
*B42D 25/47* (2014.01)

(52) U.S. Cl.
CPC ..... *B42D 25/351* (2014.10); *B42D 25/435* (2014.10); *B42D 25/47* (2014.10)

(58) Field of Classification Search
USPC ..... 359/2, 567; 283/72–114
See application file for complete search history.

(56) References Cited

U.S. PATENT DOCUMENTS

2006/0251863 A1* 11/2006 Katschorek ..... G02B 5/3016 428/172
2007/0263285 A1* 11/2007 Walter ..... B42D 15/00 359/566

FOREIGN PATENT DOCUMENTS

| | | | |
|---|---|---|---|
| EP | 2447744 | A1 | 5/2012 |
| FR | 2509873 | A1 | 1/1983 |
| WO | 2006/038120 | A1 | 4/2006 |

OTHER PUBLICATIONS

Written Opinion of the International Searching Authority issued in PCT/EP2014/070458 dated Jan. 9, 2015 (5 pages).
International Preliminary Report on Patentability from PCT/EP2014/070458 dated Oct. 16, 2015 with English Translation (18 pages).
French Preliminary Search Report issued in FR 1361338 dated Jul. 25, 2014 (6 pages).

* cited by examiner

CUSTOMIZABLE DOCUMENT FOR PRODUCING A SECURITY DOCUMENT, CUSTOMIZED SECURITY DOCUMENT AND PRODUCTION OF SUCH A SECURITY DOCUMENT

FIELD OF THE INVENTION

The present invention concerns the field of security marking. More particularly, it pertains to a persona liable document for the fabrication of a personalized security document, for example a document of polymer material such as a card or sheet, designed to be inserted in a passport and able to be authenticated by the naked eye in visible light.

PRIOR ART

Identity and travel documents such as national identity cards, driving permits, passports, visas, or registration certificates are fundamental means of control for a country. The solutions employed to prevent counterfeiting and modification of official documents are supposed to guarantee not only the authenticity of identity documents and travel documents, but also the protection of personal data such as name, date of birth, and photo. The security should be both easy to verify, yet also hard to imitate.

Many technologies implemented for the securing of means of payment and official documents are based on variable optical effects easily authenticated by the naked eye, such as holograms. The applicant has thus developed an innovative technology based on the making of holograms in volume by a direct method of registration of Bragg planes in a photopolymer material (see, for example, EP2238516B1). This technology enables the holographic registration of the personal data of the bearer of the document within the security layer, offering a very high level of security by combining personalization and visual elements.

Among the optical effects easily authenticated by the naked eye are also those based on changes of color by azimuthal rotation of the component.

The published patent application FR 2509873 thus describes an optical security component observable in direct reflection and comprising a layer of transparent dielectric material with high index of refraction, encapsulated between two layers of low index, and structured to form a subwavelength grating. Such a component, known by the abbreviation DID or "Diffractive Identification Device", behaves like a structured waveguide, making it possible to excite resonances of guided modes at different wavelengths depending on fee polarization, the angle of incidence and the azimuth. In direct reflection (diffraction order 0), such a component thus behaves like a wavelength subtractive filter, or pass band filter, forming a colored mirror whose color varies by azimuthal rotation of the component.

The published patent EP 1 775 142 describes an optical security component whose optical effect is reinforced thanks to the superpositioning of two devices of DID type, separated by a predetermined distance.

The present invention provides a security document which can be checked by zero order reflection and with the naked eye by an observer, likewise based on the DID technology, but allowing, like the technology based on the registration of holograms in volume, a personalizing of the optical effect by personal data belonging to each holder of the document. The invention also concerns a method of fabrication of such a document.

SUMMARY OF THE INVENTION

According to a first aspect, the invention concerns a personalizable document for the fabrication of a personalized security document, the personalized security document being designed to be authenticated in a spectral band of observation between 380 nm and 780 nm. The personalizable document according to the present description comprises:

a layer personalizable by contact-free writing of an opaque personalization mask which is transparent in the spectral band of observation in at least one zone of transparency, a first multilayer film arranged on a first side of the personalizable layer, and covering at least part of the zone of transparency, the first multilayer film comprising a layer of high index of refraction encapsulated between two layers of low index of refraction, and structured on at least part of its surface to form a first subwavelength grating characterized by a first grating vector, such that the first multilayer film acts in zero order like a wavelength subtractive filter, a second multilayer film arranged on a second side of the personalizable layer, opposite the first side, and covering at least part of the zone of transparency, the second multilayer film comprising a layer of high index of refraction encapsulated between two layers of low index of refraction, and structured on at least part of its surface so form a second subwavelength grating characterized by a second grating vector, such that the second multilayer film acts in zero order like a wavelength subtractive filter, the first and second gratings being at least partly superpositioned.

This original arrangement of a personalizable document, after the writing of the opaque personalization mask, makes it possible to obtain a security document which can be authenticated by the naked eye in simple and reproducible manner for all the documents, by simple azimuthal rotation of the document, the visual effect being furthermore associated with personalization data of the document. In fact each multilayer film thus defined acts like a DID component whose visual effects are combined as a function of the personalization data written in the personalizable layer.

The personalizable layer is advantageously a layer which is personalizable by laser engraving, for example, a layer of polymer material of polycarbonate type, comprising laser-reactive additives, which additives can become opaque under laser light.

According to one embodiment, the first and second grating vectors of the first and second multilayer films form respectively a first and second DID component having parallel or perpendicular directions, advantageously oriented along the natural directions (length and width) of the personalizable document. The coupling in the DID components is then maximal for the same axes of observation, which makes it possible to have highly contrasting visual effects.

Advantageously, when the first and second grating vectors have parallel directions, the norms of the grating vectors are different, so as to generate different visual effects for each DID component.

On the contrary, when the first and second grating vectors have perpendicular directions, they can have identical norms according to one embodiment. This particular instance of presentation of the structured parts of the first and second multilayer films makes it possible to have, during the authentication of the document after personalization, a stable color background by azimuthal rotation of the personalized security document, while the personalization data change color.

According to one embodiment, the structured part of one multilayer film has at least one region not superpositioned on the structured part of the other multilayer film, it is thus possible to create supplemental visual effects in the area of the regions without superpositioning of the structured parts of the multilayer films.

According to one embodiment, the personalizable document according to the present description furthermore comprises an opaque structure layer, the personalizable layer and the first and second multilayer films being arranged on the same side of the opaque structure layer. This opaque structure layer is, for example, in the case of a personalizable document obtained by stacking and fusion of a certain number of structure layers, the layer forming the core of the document. This layer, known as the card core in the case of a personalizable document of card type, is generally thicker than the other structure layers and can carry the electronic components forming the chip in the case of a chip card. The personalized security document obtained from the personalizable document thus described will be able to be authenticated on only one side (recto).

Alternatively, the personalizable document according to the present description can comprise an assemblage of structure layers, all of them being transparent in the spectral band of observation, at least in the area of the zone of transparency. The personalized security document obtained from the personalizable document thus described will be able to be authenticated on two sides (recto and verso). For example, in the case of a personalizable document obtained by stacking and fusion of a certain number of structure layers, the layer forming the core of the document, or the card core in the case of a document of card type, can be opaque except in the zone of transparency, thanks to a partial opacification or by inserting a window of transparency. According to one embodiment, the structure layer forming the core of the document thus defined is also the personalizable layer.

According to a second aspect, the invention concerns a personalized security document obtained by writing of an opaque personalization mask in the thickness of the personalizable layer of the personalizable document according to the first aspect.

The personalized security document thus comprises a personalizable document according to the first aspect, in which an opaque personalization mask is written in the zone of transparency of the personalizable layer.

The personalization mask reproduces, for example, the identity photo of the bearer, already printed or marked by laser on the document.

According to one embodiment, the personalization mask has a variable opacity, so as to generate different visual effects in different regions of the personalization data.

According to a third aspect, the invention concerns a method of fabrication of a personalized security document designed to be authenticated in a spectral band of observation between 380 nm and 780 nm, involving:

the arranging, on each of the opposite sides of a layer transparent in at least one zone of transparency in the spectral band of observation and personalizable by contact-free writing of an opaque personalization mask, of a first multilayer film and a second multilayer film, such that:

each of the first and second multilayer films comprises a layer of high index of refraction encapsulated between two layers of low index of refraction, structured on at least a portion of its surface to form respectively a first and a second subwavelength grating, such that the first and second multilayer films act in the zero order as wavelength subtractive filters, the first and second multilayer films are arranged in the area of the zone of transparency of the personalizable layer such that the first and second gratings are at least partly superpositioned;

the contact-free writing of an opaque personalization mask in the personalizable layer.

According to one embodiment, the contact-free writing of the opaque personalization mask is done by laser engraving.

According to one embodiment, the method involves the fabrication of each of the multilayer films on a structure layer which is transparent at least in the area of the zone of transparency. This embodiment enables an easy manipulation of the multilayer films, after which the structure layers carrying the multilayer films can be integrated like the other structure layers in a personalizable document obtained by stacking and fusion of structure layers.

According to one embodiment, the structure layers supporting the multilayer films are then arranged on either side of the personalizable layer.

Alternatively, the method can involve the fabrication of at least one of said multilayer films directly on the personalizable layer.

According to one embodiment, the method involves the fabrication of at least one of said multilayer films on a structure layer, said fabrication involving:

The deposition on a support layer of a first layer of low index, the structured layer of high index and a second layer of low index, The transfer of the stack of layers so obtained onto the structure layer, The removal of the support layer.

BRIEF DESCRIPTION OF THE FIGURES

Other characteristics and advantages of the invention will appear from the perusal of the following description, illustrated by the figures which show.

DETAILED DESCRIPTION

The figures are presented for the purpose of illustration and are not representative of either the scales or the shapes of the actual components.

Figure 1:
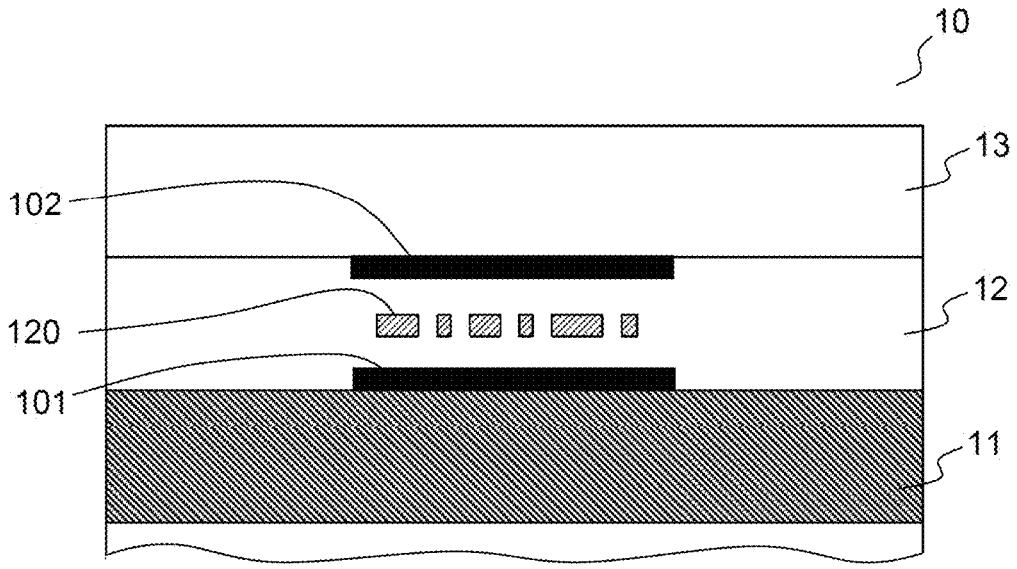
FIG. 1, a partial sectional view of a personalized security document according to the invention in a first embodiment.
Figure 2:
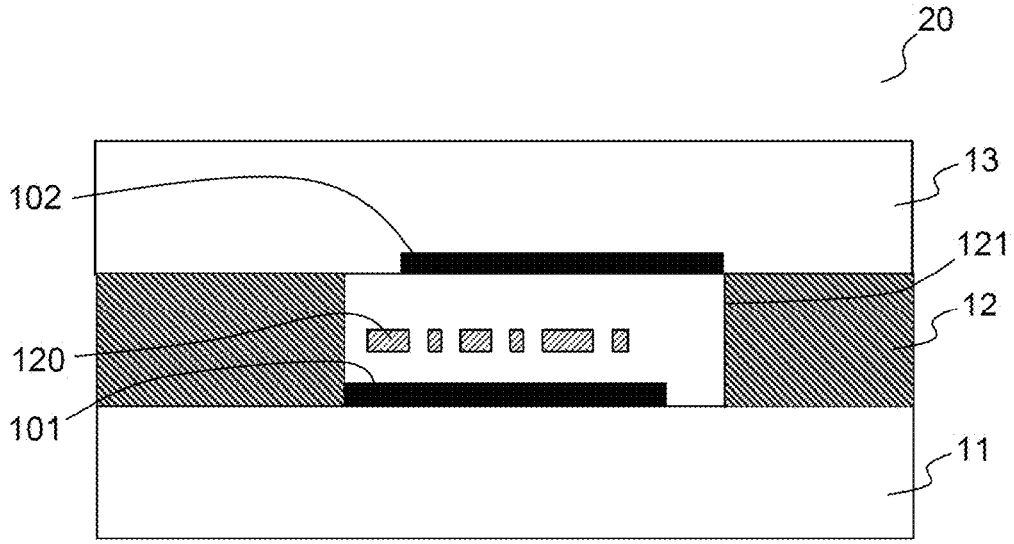
FIG. 2, a partial sectional view of a personalized security document according to the invention in a second embodiment.

FIGS. 1 and 2 show, in partial sectional views, two examples of a security document according to the present description, for example, a multilayered document of polymer material of the bank card or identity card type, or a passport sheet. This type of document is generally formed in familiar fashion from an assemblage of structure layers with a thickness generally comprised between 50 and 400 μm, fused together to form a document of nominal thickness 750 μm. The structure layers are generally of plastic material, such as polycarbonate; among the assemblage of layers, one layer generally being thicker forms the core of the document or the "card core" in the case of a document of card type, and the other structure layers are distributed equally on each side of the card core to form the body of the card after the fusion.

Thus, in the particular example of FIG. 1, the multilayer structure comprises an opaque card core 11 shown by hatching and structure layers on either side (in the example of FIG. 1, only the structure layers on one side of the card core are shown). In the example of FIG. 2, the card core referenced 12 is partially opaque, and comprises a window of transparency 121.

The personalized security document 10 shown in FIG. 1 is designed to be authenticated by direct reflection with the naked eye, in a spectral band of observation comprised between 380 nm and 780 nm. In this example, among the structure layers forming the card (or more generally, the document), the layer 12 is a transparent layer in the spectral band of observation, personalizable for example by laser engraving so as to be able to indicate personalization data belonging to the card bearer. The layer 12 is, for example, a polycarbonate layer in which additives reactive to laser light have been incorporated. The personalization data is thus present in the form of an opaque personalization mask 120, generally discontinuous. For example, the personalization mask reproduces the identity photo of the document holder, it being furthermore possible to register the identity photo on a chip in the document, or to print said photo on the document or engrave said photo—for example by laser engraving—in the document.

On each of the sides of the personalized layer 12 there are arranged multilayer films 101, 102 forming components of DID type, such that the two films are at least partly superpositioned. The thicknesses of the multilayer films are generally less than around ten micrometers. Thus, in the example of FIG. 1, the security document 100 comprises a first multilayer film 101 arranged on a first side of the personalized layer 12 and a second multilayer film 102 arranged on a second side of the personalized layer 12, opposite the first side. As will be described in more detail below, each of the multilayer films comprises a layer of high index of refraction encapsulated between two layers of low index of refraction, and structured on at least a portion of its surface to form a subwavelength grating characterized by a grating vector, such that each of the multilayer films acts in the zero order as a wavelength subtractive filter. Thus, each of the multilayer films 101, 102 acts as a DID component characterized by a grating vector. The first and second gratings have grating vectors differing in norm and/or direction, so that the coupling wavelength of each of the gratings for a given direction of observation is different.

In the example of FIG. 1, the personalized security document comprises besides the personalizable layer 12 other structure layers 11, 13, of which the structure layer 11 forms the card core. In this example, the card core 11 is completely opaque, for example made from white plastic. The personalizable layer 12 and the multilayer films 101, 102 are arranged on the same side of the layer 11 forming the card core. The structure layer 13 is transparent and moreover forms in this example a protection layer for the multilayer film 102. Other structure layers (not shown), for example layers of transparent plastic, are advantageously arranged on the opposite side of the layer 11 forming the card core so that there is essentially an identical thickness of layers on either side of the layer 11 forming the card core. The authentication of the security document 10 is thus intended to be done only on a single side, the side of the document comprising the personalizable layer 12 and the multilayer films 101, 102. The structure layers other than the personalizable layer 12 can likewise be personalizable layers, for example, by laser engraving. However, during the engraving of these layers, one will avoid creating zones of opacity in the area of the multilayer films so as to avoid the risk, during the personalization of the document by writing of the personalization mask in the personalizable layer 12 situated between the multilayer films 101, 102, of introducing parasitic zones of opacity between the surface of observation and the slack of first multilayer film 101—personalizable layer 12—second multilayer film 102.

FIG. 2 shows a security document 20 essentially similar to the security document 10 shown in FIG. 1, but in this particular example the personalized layer 12 forms the card core; it is opaque except in a zone of transparency 121. For example, the layer 12 is formed of whitened plastic, such as polycarbonate, and comprises a window of transparent material. For example, the card core is transparent and rendered opaque by an opacifying imprinting on each surface, or the card core is opaque and there is an integrated transparent insert. The personalization mask 120 is then formed for example by laser engraving in the zone of transparency 121. The multilayer films 101 and 102 are arranged in this embodiment on either side of the personalized layer 12 so as to cover at least part of the zone of transparency 121. In this example, other structure layers 11 and 13 are arranged on either side of the layer 12 forming the card core, and they likewise form protection layers of the multilayer films 101 and 102. These structure layers are transparent and help make the card more rigid. In this example, the authentication of the document 20 can be done on two sides, recto and verso, which offers a new type of control, as will be illustrated below.

Alternatively, it is possible to contemplate a card core of the type in FIG. 2, opaque with a window of transparency, and a stack of first multilayer film 101—personalizable layer 12—second multilayer film 102 of the type in FIG. 1, arranged on one side of the layer forming the card core. In this embodiment, the authentification of the document can also be done on two sides, recto and verso, in this case, as in the case of FIG. 2, one will make sure during the personalization of the document not to write anything in the structure layers situated between each of the surfaces of observation (recto and verso) and the stack of first multilayer film 101—personalizable layer 12—second multilayer film 102, to avoid introducing parasitic zones of opacity.

As will be evident from the examples of FIGS. 1 and 2, the multilayer films 101 and 102 or more precisely the structured zones of the multilayer films forming the first and second gratings as well as the personalization mask 120 overlap at least partially, but are not necessarily perfectly superpositioned, which makes it possible to generate particular visual effects.

Figure 3A:
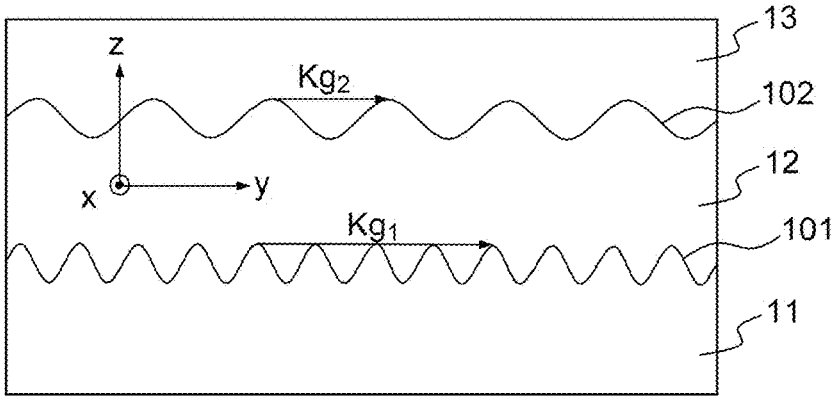
FIGS. 3A and 3B, diagrams illustrating the grating vectors associated with the first and second multilayer films in a sample embodiment.
Figure 3B:
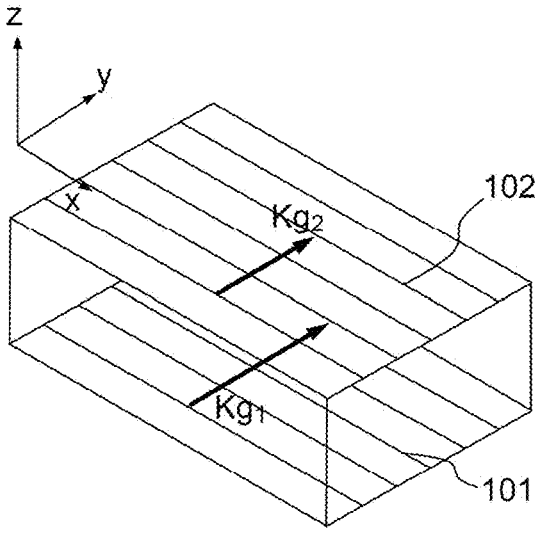

FIGS. 3A and 3B present a first particular embodiment of the first and second gratings. FIG. 3A shows a partial sectional view of a security document in which the multilayer films 101 and 102 are symbolized by the gratings, formed here by one-dimensional sinusoidal structurizations forming grating hoes in one direction. The gratings are defined respectively by grating vectors $Kg_1$ and $Kg_2$ of given directions and norms. The direction of the grating vector is given by the direction perpendicular to the direction of the grating lines. The norm of the grating vector is inversely proportional to the period of the grating with which it is associated. The multilayer films are arranged on either side of the personalizable layer 12 (the personalization mask is not shown in FIGS. 3A and 3B) and furthermore they are in contact respectively with structure layers 11 and 13. FIG. 3B shows a partial perspective view of the gratings where only the grating lines are represented, being perpendicular to the direction of the grating vectors $Kg_1$ and $Kg_2$.

FIGS. 3A and 3B illustrate the particular case in which the grating vectors have the same direction and different norms.

Figure 4:
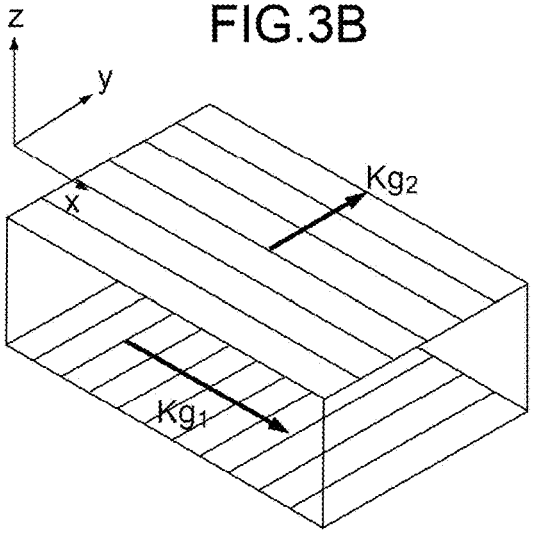
FIG. 4, a diagram illustrating the grating vectors associated with the first and second multilayer films in another sample embodiment.

FIG. 4, like FIG. 3B, shows a partial perspective view of the gratings where only the grating lines are represented, and illustrates another particular example in which the grating vectors have perpendicular directions but identical norms (gratings of the same period).

In the two cases, the grating vectors are advantageously aligned with the axes of the document (axes defining the width and the length).

FIGS. 5A to 5D illustrate the visual effects obtained with a personalizable document in the particular example of grating vectors of identical directions but different norms, as illustrated in FIGS. 3A and 3B, prior to personalization of the personalizable layer 12 (the personalization mask is not yet formed). It is assumed that the security document is illuminated by white light.

Figure 5C:
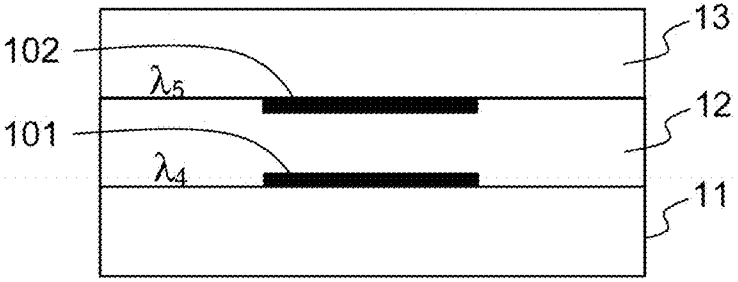
FIGS. 5A to 5D, diagrams illustrating visual effects obtained with a first example of a personalizable document, prior to personalization of the document, in a case of grating vectors of the same direction and different norms.
Figure 5D:
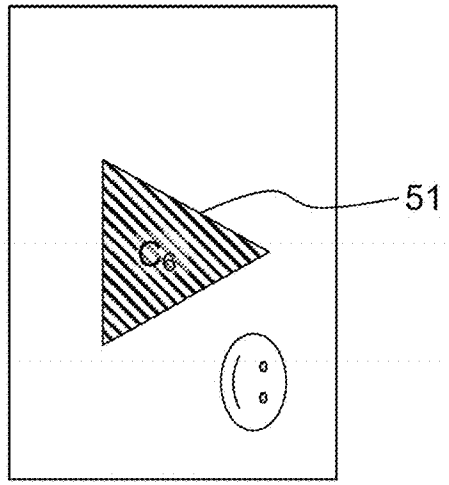
Figure 5A:
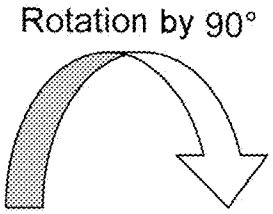
Figure 5A:
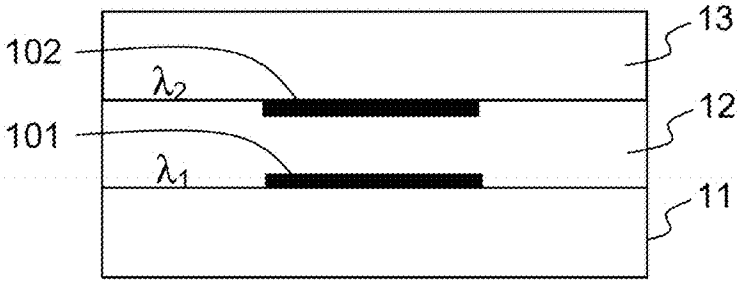
Figure 5B:
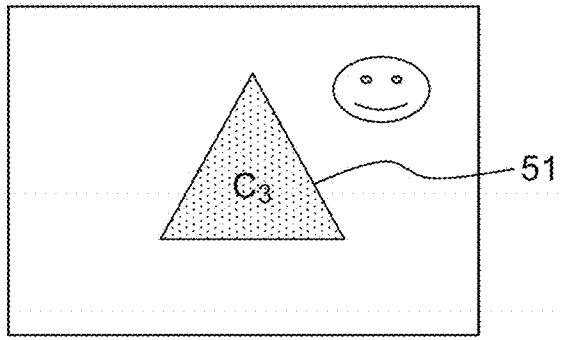

FIGS. 5A and 5C show schematically partial sectional views of the personalizable document, while FIGS. 5B and 5D show top views (recto), for two azimuth angles of the component separated by 90°. Thus, in FIGS. 5A and 5B the personalizable observation is done along an axis of observation of the document parallel to the direction of the grating vectors while in FIGS. 5C and 5D the observation of the personalizable document is done along an axis of observation of the document perpendicular to the direction of the grating vectors. When the axis of observation is parallel to the direction of the grating vectors, the coupling wavelength in the multilayer film 101 forming a first DID component is referenced $\lambda_1$ and the coupling wavelength in the multilayer film 102 forming a second DID component is referenced $\lambda_2$ (FIG. 5A). In known manner, when the document undergoes an azimuthal rotation of 90°, the coupling wavelength in each of the DID components 101, 102 changes; this is referenced respectively $\lambda_4$ for the DID component 101 and $\lambda_5$ for the DID component 102 (FIG. 5C). Each DID component acts like a wavelength subtractive mirror which reflects a light wave whose spectral band depends on the coupling wavelength. Thus, when the observation is done along the axis parallel to the direction of the grating vectors (FIG. 5B), one observes in the location of the multilayer films arranged in this example with a pattern of triangle shape 51 a "color" C3 which results from the combined effects of coupling in the DID components 101 and 102 respectively of the waves with wavelengths $\lambda_1$ and $\lambda_2$. If one rotates the personalizable document by 90° for example, so that the axis of observation is perpendicular to the direction of the grating vectors (FIG. 5D), one observes in the location of the multilayer films a "color" C6 which results from the combined effects of coupling in the DID components 101 and 102 respectively of the waves with wavelengths $\lambda_4$ and $\lambda_5$.

Figures 6A, 6B, 6C, 6D, 6E, 6F:
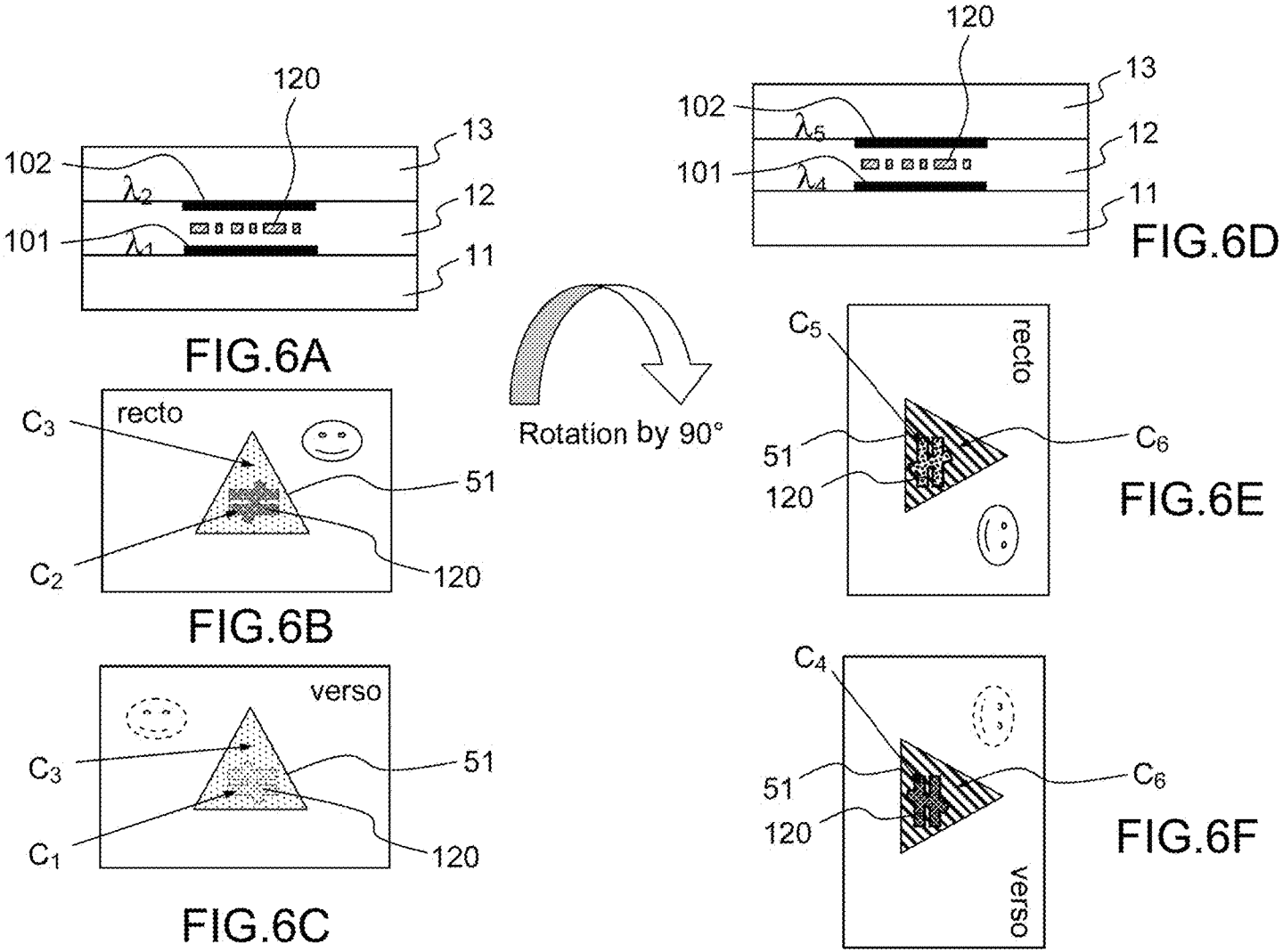
FIGS. 6A to 6F, diagrams illustrating visual effects obtained with the first example described in FIGS. 5A to 5D, after personalization of the security document.

FIGS. 6A to 6F illustrate the visual effects obtained under conditions identical to those used in the example of FIGS. 5A to 5D, but this time after personalization of the personalizable layer 12. The personalization mask in this example is in the shape of the sign "≠" and it is referenced as 120. It is assumed in this example, as in the example of FIG. 2, that the structure layers 11 and 13 are transparent, allowing a compared observation of the visual effects of the recto and verso side. Thus, FIGS. 6A to 6C show the personalized security document when the observation is done along an axis of observation for example parallel to the direction of the grating vectors, while FIGS. 6D to 6F show the personalized security document when the observation is done along an axis of observation for example perpendicular to the direction of the grating vectors. FIGS. 6A and 6D are partial sectional views of the personalized security document; FIGS. 6B and 6E show the observation of the document on the recto side and FIGS. 6C and 6F show the observation of the document on the verso side.

As in the case of FIGS. 5B and 5D, in the case of the observation along the axis parallel to the direction of the grating vectors on the recto side (FIG. 6B) one observes in the superpositioning location of the multilayer films the color C3, resulting from the combined coupling effects in the DID components 101 and 102 respectively of the waves with wavelengths $\lambda_1$ and $\lambda_2$. If one rotates the security document by 90°, so that the axis of observation is perpendicular to the direction of the grating vectors (FIG. 6E), one observes in the superpositioning location of the multilayer films the color C6 which results from the combined effects of coupling in the DID components 101 and 102 respectively of the waves with wavelengths $\lambda_4$ and $\lambda_5$.

On the other hand, in the location of the personalization mask 120 one always observes on the recto side and along the first axis of observation (FIG. 6B) a "color" C2 which results from the effect of the DID component 102 alone. In fact, the mask conceals the light which might be reflected by the DID component 101. When one rotates the security document by 90° (FIG. 6E), one observes a different color C5. Thus, the rotation of the security document in its plane produces in remarkable manner a visual effect which is personalized as a function of the personalization data of the security document.

The authentication of the personalized security document can thus be done by mere observation of the recto side of the component.

In the particular example of FIGS. 6A to 6F, a supplemental authentication of the security document can likewise be done by compared observation of the recto and verso sides of the document.

Thus, FIG. 6C shows the observation of the component on the verso side, when the observation is done along the axis of observation parallel to the direction of the grating vectors. One observes that the motif 51 corresponding to the zone of superpositioning of the multilayer films 101, 102, or more precisely the first and second gratings, is essentially of the same color C3 as on the recto side. In fact, the visual effect results from the coupling in the two DID components 101 and 102. In the area of the personalization mask, on the contrary, one observes a "color" C1 which results from the effect of the DID component 101 alone and which thus differs from the color C2 of the personalization data visible on the recto side. Thus, the compared observation of the recto and the verso reveals a stable background color (C3) whereas the color of the personalization data varies. When one rotates the security document by 90° (FIG. 6F), one observes in the area of the personalization mask, on the verso side, a different color C4 resulting from the coupling in the DID component 101 alone. The authentication of the personalized security document is thus possible not only on the two sides, recto and verso, but also by comparison of the recto and the verso.

One advantage of a configuration in which fee grating vectors have the same directions is that the coupling effect is maximal for the same axes of observation perpendicular to each other, which makes it possible to have highly contrasting visual effects.

This same advantage occurs when the directions of the grating vectors are perpendicular.

FIGS. 7A to 7D and 8A to 8F thus illustrate another example in which, as with the example of FIG. 4, the grating vectors of the first and second gratings are perpendicular. Moreover, in this particular example, their norms are identical.

FIGS. 7A to 7D thus illustrate the visual effects obtained with a personalizable document in which the directions of the grating vectors of the first and second gratings are perpendicular and their norms are identical, prior to personalization of the personalizable layer 12 (the personalization mask is not yet formed). It is assumed here too that the personalizable document is illuminated by white light.

Figure 7C:
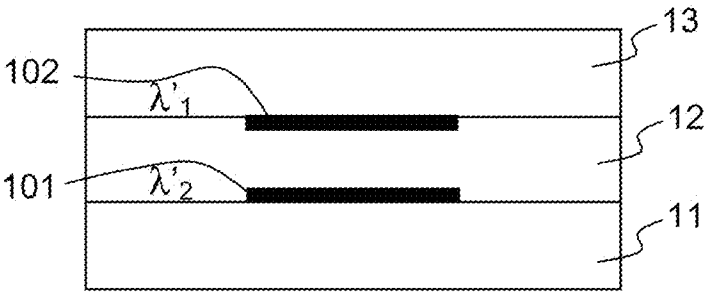
FIGS. 7A to 7D, diagrams illustrating visual effects obtained with a second example of a personalizable document, prior to personalization of the document, in a case of grating vectors of perpendicular directions and identical norms.
Figure 7D:
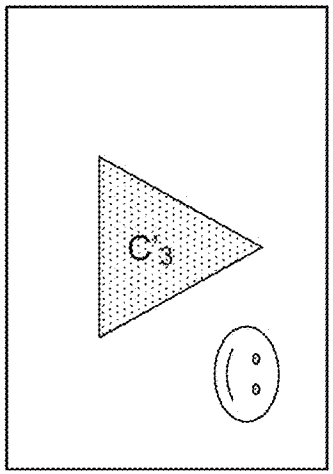
Figure 7A:
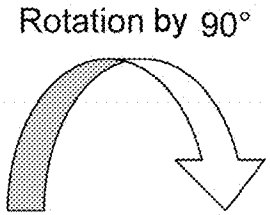
Figure 7A:
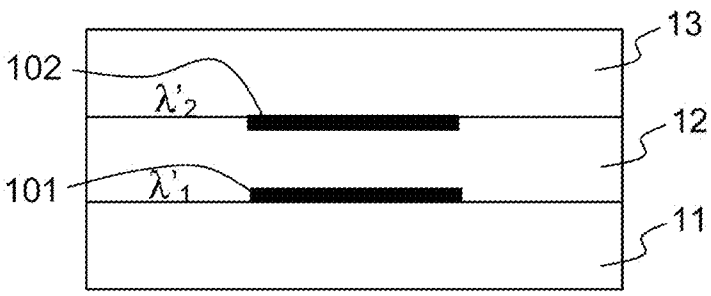
Figure 7B:
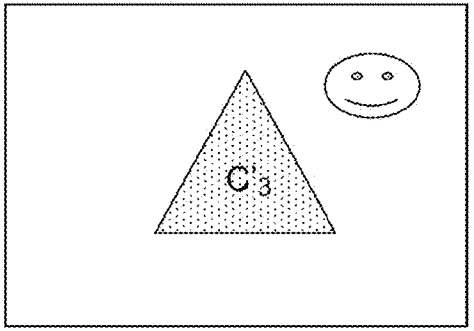

FIGS. 7A and 7C show schematically partial sectional views of the security document while FIGS. 7B and 7D show top views (recto), for two azimuth angles of the component separated by 90°. For example, FIGS. 7A and 7B illustrate the security document when the observation is done along an axis of observation of the document for example parallel to the direction of the grating vector $Kg_1$ and perpendicular to the direction of the grating vector $Kg_2$ while FIGS. 7C and 7D illustrate the security document after azimuthal rotation of 90°, the observation occurring along an axis of observation of the document parallel to the direction of the grating vector $Kg_2$ and perpendicular to the direction of the grating vector $Kg_1$. When the axis of observation is parallel to the direction of the grating vector $Kg_1$ and perpendicular to the direction of the grating vector $Kg_1$, the coupling wavelength in the multilayer film 101 forming a first DID component is referenced $\lambda'_1$ and the coupling wavelength in the multilayer film 102 forming a second DID component is referenced $\lambda'_2$ (FIG. 7A). In this particular example, since the norms of the grating vectors are identical, when the personalizable document undergoes an azimuthal rotation of 90° the coupling wavelength in each of the DID components 101, 102 becomes respectively $\lambda'_2$ for the DID component 101 and $\lambda'_1$ for the DID component 102 (FIG. 7C). Each DID component acts like a wavelength subtractive mirror which reflects a light wave whose spectral band depends on the coupling wavelength. Thus, in the case of the observation along the first axis of observation (FIG. 7B), one observes in the location of the multilayer films, arranged in this example again with a motif of triangle shape 51, a "color" C'3 resulting from the combined coupling effects in the DID components 101 and 102 respectively of the waves with wavelengths and $\lambda'_2$. If one rotates the security document by 90° (FIG. 7D), one observes in the location of the multilayer films and contrary to the example of FIGS. 5A to 5D the same color C'3 resulting from the combined coupling effects in the DID components 101 and 102 respectively of the waves with wavelengths $\lambda'_2$ and $\lambda'_1$. Thus, one observes in this example a stability of the background color by rotation of the security document in its plane.

Figures 8A, 8B, 8C, 8D, 8E, 8F:
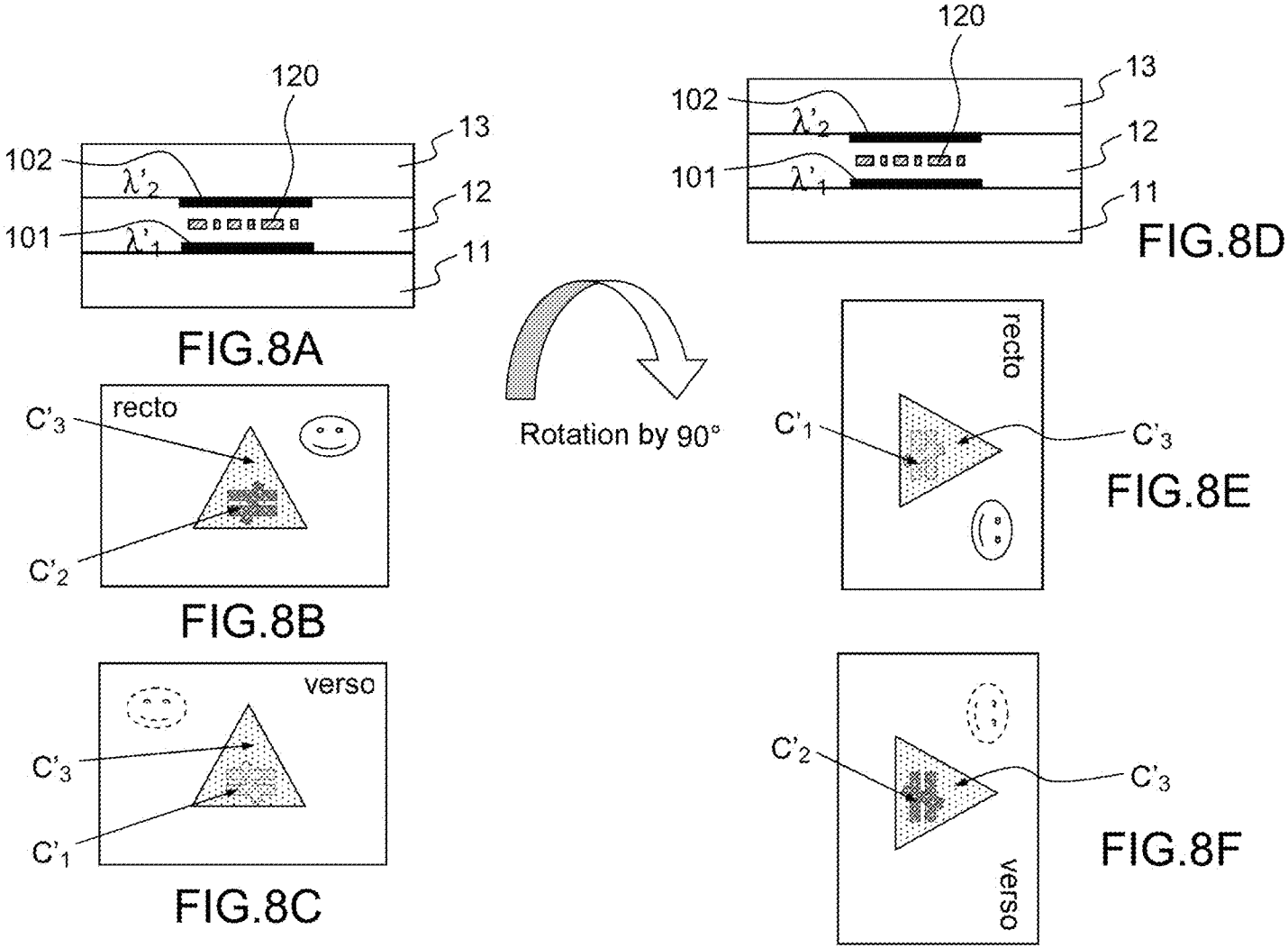
FIGS. 8A to 8F, diagrams illustrating visual effects obtained with the second example described in FIGS. 7A to 7D, after personalization of the security document.

FIGS. 8A to 8F illustrate the visual effects obtained under identical conditions to those used in the example of FIGS. 7A to 7D, but this time after personalization of the personalizable layer 12. The personalization mask again in this example is presented in the form of the sign "≠" and is referenced as 120. It is assumed in this example, as in the example of FIG. 2, that the structure layers 11 and 13 are transparent, allowing a compared observation of the visual effects of the recto and verso side. Thus, FIGS. 8A to 8C show the personalized security document when the observation is done along an axis for example parallel to the direction of the grating vector $Kg_1$ and perpendicular to the direction of the grating vector $Kg_2$, while FIGS. 8D to 8F show the personalized security document after azimuthal rotation of 90°, when the observation is done along an axis parallel to the direction of the grating vector $Kg_2$ and perpendicular to the direction of the grating vector $Kg_1$. FIGS. 8A and 8D are partial sectional views of the security document; FIGS. 8B and 8E show the observation of the document on the recto side and FIGS. 8C and 8F show the observation of the document on the verso side.

As in the case of FIGS. 7B and 7D, in the case of the observation along the axis parallel to the direction of the grating vector $Kg_1$ and perpendicular to the direction of the grating vector $Kg_2$ (FIG. 8B) one observes in the superpositioning location of the multilayer films the color C'3 resulting from the combined coupling effects in the DID components 101 and 102, respectively, of the waves with wavelengths $\lambda'_1$ and $\lambda'_2$. By rotating the security document through 90° (FIG. 8E), one observes in this case a stability of the color in the superpositioning location of the multilayer films.

In the location of the personalization mask 120, one observes on the recto and in the case of the observation along the axis parallel to the direction of the grating vector $Kg_1$ and perpendicular to the direction of the grating vector $Kg_2$ (FIG. 8B) a color C'2 which results from the effect of the DID component 102 alone. In fact, as in the previous example, the mask conceals the light which might be reflected by the DID component 101. When one rotates the security document through 90° (FIG. 8E), one observes a color C'1 different from C'2, however the background remains stable (color C'3). Thus, the rotation of the security document in its plane produces a visual effect which is personalized as a function of the personalization data of the security document, which is furthermore observed against a stable color background, further facilitating the authentication.

As in the example of FIGS. 6A to 6F, a supplemental authentication of the security document can be done in the example of FIG. 8A to 8F by compared observation of the recto and verso sides of the document.

Thus, FIG. 8C shows the observation of the component on the verso side, when the observation is done along the axis parallel to the direction of the grating vector $Kg_1$ and perpendicular to the direction of the grating vector $Kg_2$. One observes that the motif 51 corresponding to the zone of superpositioning of the multilayer films 101, 102, or more precisely the first and second gratings, is of the same color C'3 as on the recto side. In the area of the personalization mask, one observes a color C'1 which results from the effect of the DID component 101 alone and which thus differs from the color C'2 of the personalization data visible on the recto side. When one rotates the security document by 90° (FIG. 8F), one observes on the verso side a color C'2 for the personalization data, always against a stable color background (color C'3).

Thus, in this example, regardless of the side of observation of the security document, recto or verso, one observes visual effects of three colors, one color remaining stable (that of the background) by rotation of the security document in its plane, while the personalization data change from a first to a second color.

In the examples illustrated in FIGS. 5 to 8, the first and second multilayer films, and more precisely the first and second associated gratings, have been represented as being essentially superpositioned. According to one embodiment, it is possible for these gratings to be staggered so that in certain zones of the document there will only be a single grating, which will result in different color effects yet again.

Figure 9A:
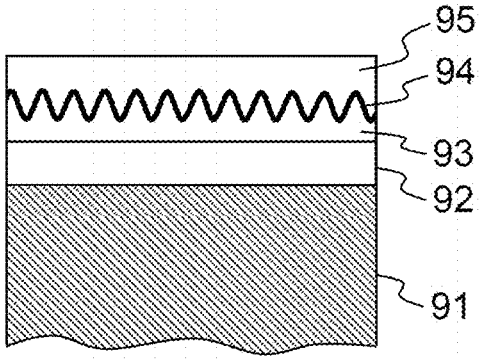
FIGS. 9A to 9C, diagrams illustrating a method of fabrication of multilayer films according to a sample embodiment.
Figure 9B:
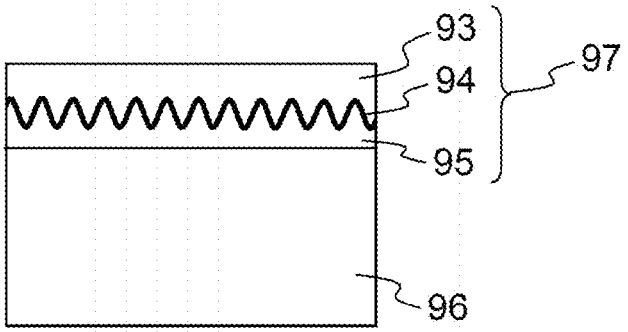
Figure 9C:
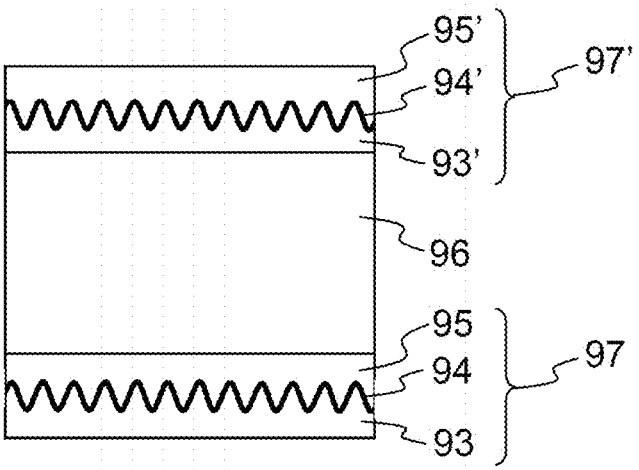

FIGS. 9A to 9C illustrate one example of a method of fabrication of multilayer films of DID type adapted for a personalizable document according to the present description.

Optical microstructures designed to form the first and second gratings are registered, for example, by photolithography or electron beam lithography, on a photosensitive support, or "photoresist". A galvanoplasty step makes it possible to transfer these optical structures to a resistant material such as one based on nickel, in order to make a die or "master". According to one embodiment, the same die can be used to form the first and second gratings, when the gratings have identical spacings.

The fabrication of a multilayer film according to one embodiment is illustrated in FIGS. 9A and 9B. It involves, for example, the depositing on a support layer 91 of a detachment layer 92 or "release layer". The support layer is, for example, a film of several tens of micrometers made of polymer material, such as PET (polyethylene terephthalate) and the detachment layer is a layer of natural or synthetic wax. On the detachment layer is deposited a first dielectric layer of low index of refraction 93, such as a cross-linkable or thermoformable varnish with a thickness of 1 to 5 μm. The deposition can be done in a pattern dictated, for example, by printing of a UV cross-linked varnish. A stamping is done based on the die to transfer the microstructure to the surface of at least part of the low index layer. The stamping can be done, for example, by molding and then cross-linking under UV ("UV casting"). A layer 94 of high index of refraction is then deposited on the first layer of low index, for example, a layer of zinc sulfide (ZnS) or titanium oxide ($TiO_2$) with a thickness typically between 40 and 200 nm, for example between 80 and 150 nm, deposited by vacuum evaporation or by an equivalent method, or made from polymer material with a high optical index. A second layer of low index of refraction 95 can then be applied, for example by a coating process, for example an adhesive layer of glue or varnish type or a layer cross-linkable under UV. In the present description, one considers materials of low index of refraction to be materials whose indices of refraction are less than the indices of refraction of the materials called materials with high index of refraction. According to one embodiment, the indices of refraction of the materials called high index materials are equal or essentially equal, for example between 1.8 and 2.9, advantageously between 2.0 and 2.4. According to one embodiment, the indices of refraction of materials called low index materials are equal or essentially equal, for example between 1.3 and 1.8, advantageously between 1.4 and 1.7.

As illustrated in FIG. 9B, die multilayer film 97 so formed by the stacking of the layers 93, 94, 95 is transferred in the hot (or cold) state to a layer 96, for example a layer of transparent plastic, such as polycarbonate, able to be integrated in a multilayer component of card type. The release layer 92 and PET layer 91 are removed and one obtains a support layer of the DID component which can be integrated in the fabrication of a document, such as a document of card type, like the other structure layers.

According to one embodiment illustrated in FIG. 9C, on the surface of the support layer 96 opposite the surface supporting the multilayer film 97 there can be deposited a stack of low index layer 93', high index layer 94', low index layer 95', in the same way as described above, in order to form a second multilayer film 97' for the formation of a second component of DID type. According to this embodiment, the same layer 96 carries on each of its surfaces respectively the first and second multilayer films 97 and 97'.

FIGS. 10A to 10J illustrate embodiments of a method of fabrication of personalizable documents according to the present description.

In these figures, the DID components are referenced respectively as DID1 and DID2 and they can be obtained by the method of fabrication described with the aid of FIGS. 9A to 9C. In these examples, the personalizable documents are obtained by stacking and fusion of 6 or 8 structure layers numbered 1 to 6 or 1 to 8. FIGS. 10A, 10C, 10E, 10G, 10I show the layers before stacking and FIGS. 10B, 10D, 10F, 10H, 10J show the personalizable documents obtained after stacking and fusion of the layers. In FIGS. 10A, 10C, 10E, 10G, 10I, the layers 1 and 2 represent the layers destined to form the core C of the personalizable document. The other structure layers, after stacking and fusion, form structure layers arranged on either side of the core layer C. The DID components are found at the side of the stacked structure of the structure layers, embedded in the structure layers.

Figure 10A:
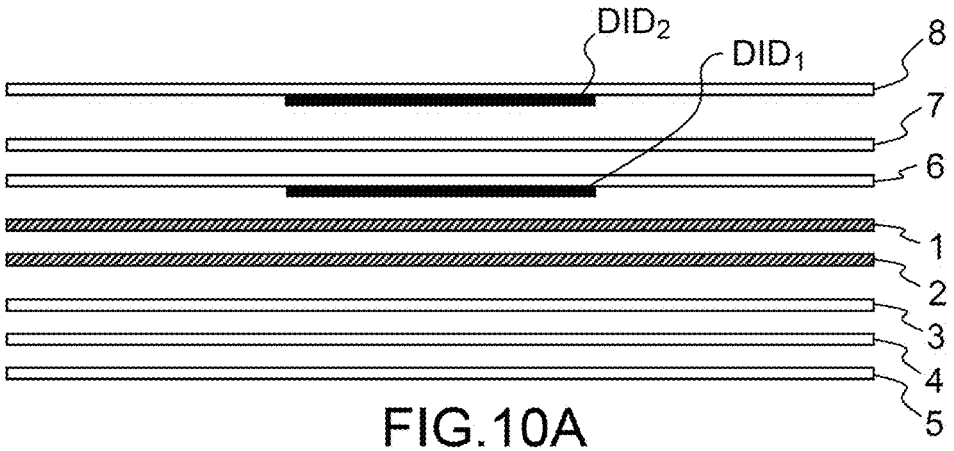
FIGS. 10A to 10J, diagrams illustrating methods of fabrication of personalizable documents for the fabrication of personalized security documents, according to sample embodiments.

In the example of FIG. 10A, the layers 1 and 2 destined to form the core are completely opaque. For example, they are layers of polycarbonate, typically 50 to 200 μm. On the side of the layer 2 is found a stack of three transparent structure layers 3, 4, 5, of thickness typically from 50 to 200 μm. On the side of the layer 1 there are found 3 structure layers 6, 7, 8; the structure layers 6 and 8 carry the components DID1 and DID2. The layer 7 situated between the support layers 6 and 8 of the DIDs is a layer personalizable by contact-free writing of the personalization mask, for example by laser engraving. The support layer 6 of DID1, destined to be in contact in this example with the layer 7, is likewise preferably a layer personalizable for example by laser engraving. The laser engraving advantageously allows a remote personalization (without direct contact), in the thickness of the layer. The personalizable layer is, for example, a layer of polycarbonate loaded with laser-sensitive additives such as those marketed by DSM under the brand Micabs™, or laserable Bayer Makrofol® ID 6-2.

Figure 10B:
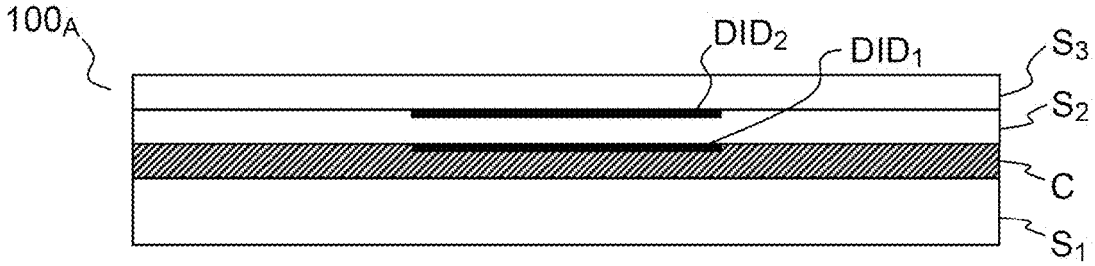

FIG. 10B shows a personalizable document $\mathbf{100}_A$ obtained by stacking and fusion of the layers illustrated in FIG. 10A. After stacking and fusion, the layers 3, 4, 5 (FIG. 10A) form only a single structure layer S1. The layers 6 and 7 (FIG. 10A) form only a single structure layer S2, personalizable for example by laser engraving, arranged between the components DID1 and DID2. The layer 8 forms a structure layer S3.

All that remains is to personalize the document, for example by laser engraving of the personalizable layer S2 situated between the components of DID type. The laser engraving consists in a blackening by application of a laser of one of the polycarbonate layers of the stack. The polycarbonate layer in question is specifically designed by the incorporation of additives to react to laser light. A variable opacity can be obtained either by control of the more or less dense raster point or by adjusting the quantity of laser energy supplied (the color of the point is a more or less intense (opaque) black depending on the laser energy). The card core being opaque in this example, the resulting personalized security document will only be able to be authenticated on the recto side, as has been described above.

Figure 10C:
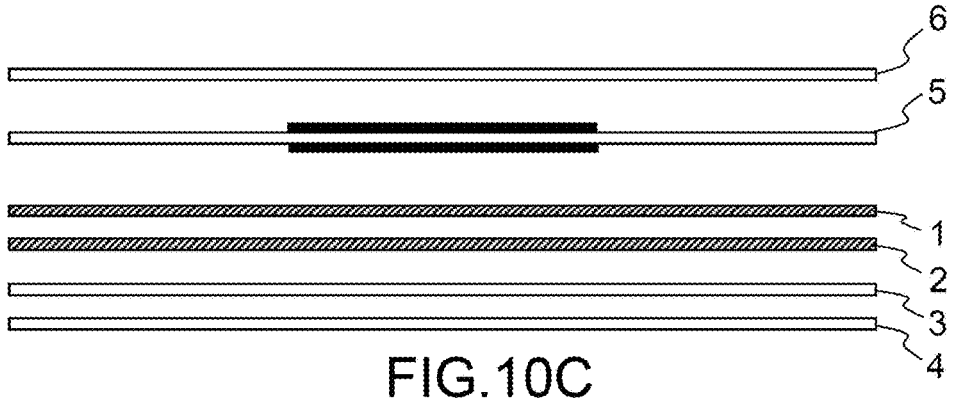
Figure 10D:
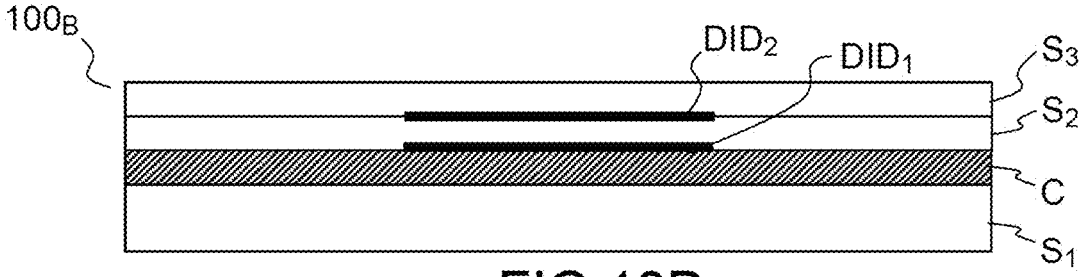

FIG. 10C shows a embodiment in which 6 layers are intended to be stacked and fused to form a personalizable document $\mathbf{100}_B$ (FIG. 10D).

As above, the stack of layers comprises two opaque layers 1 and 2 designed to form the core of the document C. On one side of the layers 1 and 2 there are found two transparent structure layers 5, 6 destined to form a single structure layer S1 after stacking and fusion. On the other side of the layers 1 and 2 there are found two structure layers 5 and 6; one layer 5 bearing on each of its surfaces the components DID1 and DID2, respectively; such a layer is obtained, for example, by a process as described in FIG. 9C. The layer 6 is a transparent structure layer, likewise destined to protect the component DID2.

After stacking and fusion of the layers represented in FIG. 10C, one obtains a personalizable document $\mathbf{100}_B$, of structure identical to that shown in FIG. 10B. The personalization of the document can then be done in a way similar to that described above.

The following figures show embodiments in which the card core C has a transparent window T.

Figure 10E:
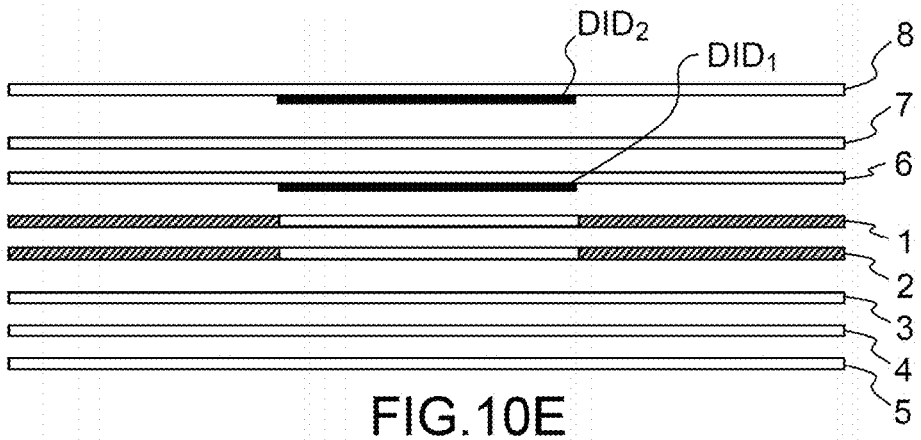

In the example of FIG. 10E, the layers 1 and 2 destined to form the core are partly opaque, having a window or zone of transparency. For example, they are layers of polycarbonate, typically from 50 to 200 μm, partially whitened, or having a transparent insert integrated in them. On the side of the layer 2 there is a stack of three transparent structure layers 3, 4, 5, of thickness typically from 50 to 200 μm. On the side of the layer 1 there are found, as in the example of FIG. 10A, 3 structure layers 6, 7, 8; the structure layers 6 and 8 carry the components DID1 and DID2. The layer 7 situated between the support layers 6 and 8 of the DIDs is a layer personalizable by laser engraving, for example. The support layer 6 of DID1, destined to be in contact in this example with the layer 7, is likewise preferably a layer personalizable by laser engraving, for example.

Figure 10F:
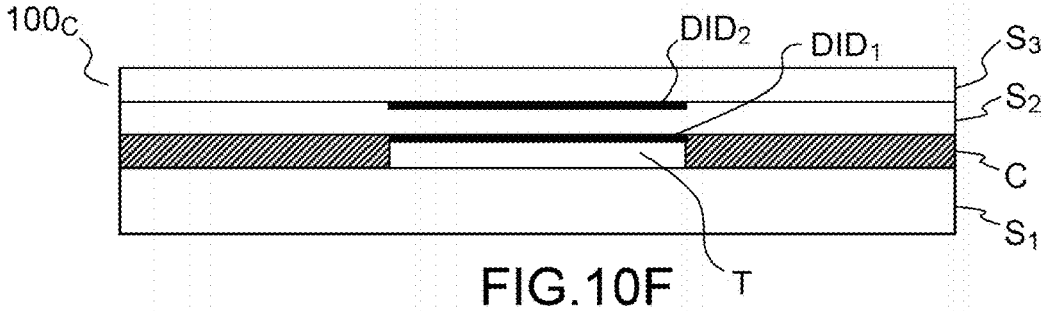

FIG. 10F shows a personalizable document $\mathbf{100}_C$ obtained by stacking and fusion of the layers illustrated in FIG. 10E. After stacking and fusion, the layers 1 and 2 form the core C, having a window of transparency T. The layers 3, 4, 5 (FIG. 10E) form only a single structure layer S1. The layers 6 and 7 (FIG. 10E) form only a single structure layer S2, personalizable by laser engraving, for example, arranged between the components DID1 and DID2. The layer 8 forms a structure layer S3. The personalization of the document can then be done in a way similar to that described above in the layer S2.

Figure 10G:
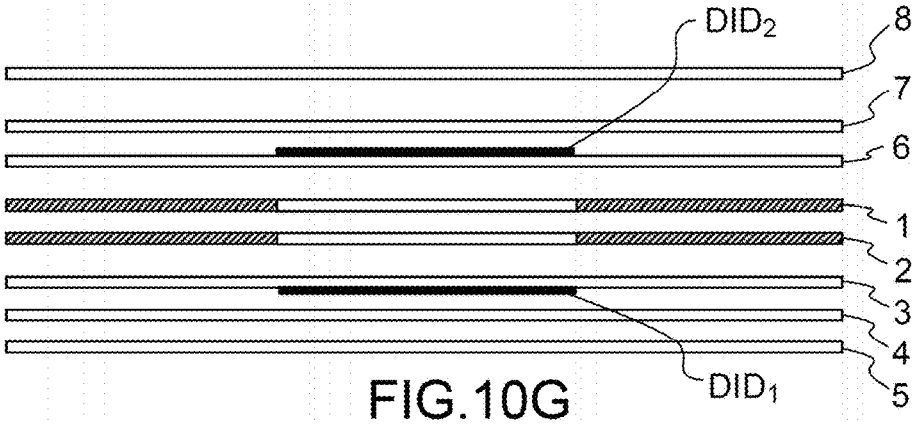

FIG. 10G shows a stack of layers similar to that represented in FIG. 10E, but in this example the components DID1 and DID2 are arranged on either side of the card core.

Thus, the stack comprises the layers 1 and 2, destined to form the core, and which are partially opaque, having a window or zone of transparency. On the side of the layer 2 there is a stack of three transparent structure layers 3, 4, 5, of which one layer, here the layer 3, carries the component DID1. On the side of the layer 1 there is a stack of three transparent structure layers 6, 7, 8, of which one layer, here the layer 6, carries the component DID2. The layers 1, 2, 3, 6 arranged between the components DID1 and DID2 are all oral least some of them personalizable for example by laser engraving.

Figure 10H:
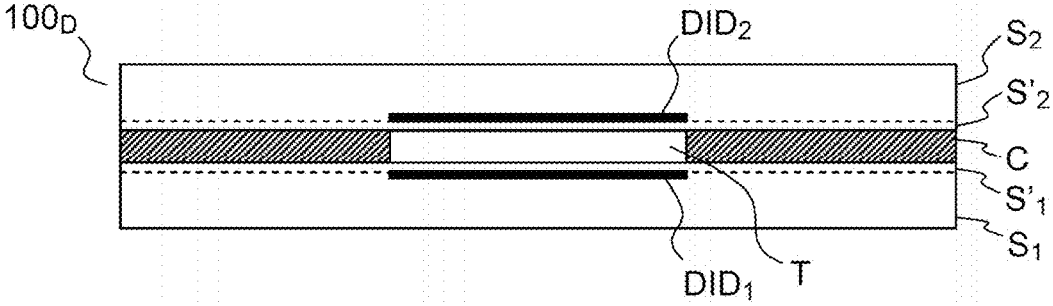

FIG. 10H shows a personalizable document $\mathbf{100}_D$ obtained by stacking and fusion of the layers illustrated in FIG. 10G. After stacking and fusion, the layers 1 and 2 form the core C, having a window of transparency T. The layers 4, 5 (FIG. 10G) form only a single structure layer S1. The layers 7 and 8 (FIG. 10G) form only a single structure layer 82. Between the components DID1 and DID2 there is a stack of layers comprising a layer S'1 (corresponding to the layer 2, FIG. 10G), the transparent zone T of the core C, a layer S'2 (corresponding to the layer 6, FIG. 10G). This stack of layers forms here the layer personalizable for example by laser engraving. The personalization of the document can then be done in a way similar to that described above in the personalizable layer.

Figure 10I:
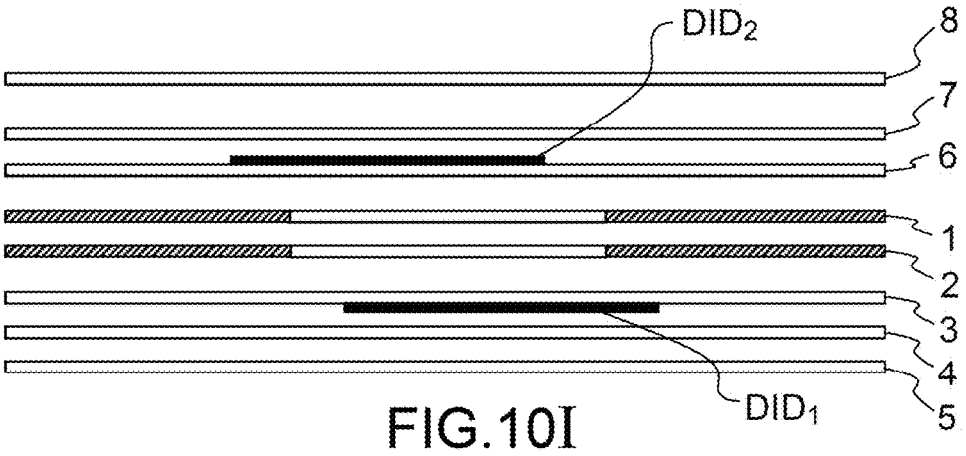
Figure 10J:
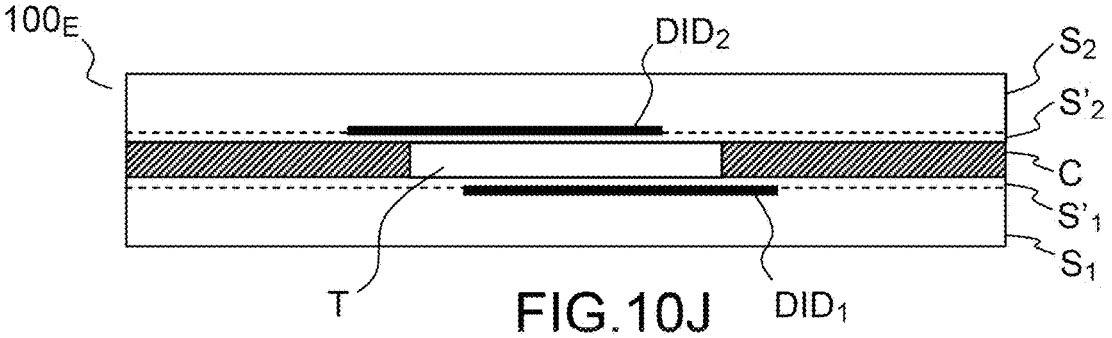

FIGS. 10I and 10J illustrate an embodiment of FIGS. 10G and 10H; the stack of layers is the same, but in this embodiment the components DID1 and DID2 are partly superpositioned. Furthermore, the component DID2 is partly superpositioned on the zone of transparency T. As explained above, this embodiment makes it possible to create supplemental visual effects in the area of the nonoverlapping zones.

Although described with a certain number of sample embodiments, the personalized security document according to the invention and the method of fabrication of said document encompass different embodiments, modifications and improvements which will be obvious to the skilled person, it being understood that these different embodiments, modifications and improvements are part of the scope of the invention as defined by the following claims.

The invention claimed is:

1. A personalizable document for the fabrication of a personalized security document designed to be authenticated in a spectral band of observation between 380 nm and 780 nm, comprising:

a layer personalizable by contact-free writing of an opaque personalization mask, wherein the personalizable layer has a thickness between 50 μm and 400 μm, is transparent in the spectral band of observation in at least one zone of transparency, and comprises additives able to become opaque under laser light;

a first multilayer film arranged on a first side of the personalizable layer, and covering at least part of the zone of transparency, the first multilayer film comprising a layer of high index of refraction encapsulated between two layers of low index of refraction, and structured on at least part of its surface to form a first subwavelength grating characterized by a first grating vector, such that the first multilayer film acts in zero order like a wavelength subtractive filter; and a second multilayer film arranged on a second side of the personalizable layer, opposite the first side, and covering at least part of the zone of transparency, the second multilayer film comprising a layer of high index of refraction encapsulated between two layers of low index of refraction, and structured on at least part of its surface to form a second subwavelength grating characterized by a second grating vector, such that the second multilayer film acts in zero order like a wavelength subtractive filter, the first and second gratings being at least partly superpositioned, wherein the first and second grating vectors have orthogonal directions.

2. The personalizable document as claimed in claim 1, wherein the first and second grating vectors have identical norms.

3. The personalizable document as claimed in claim 1, wherein the structured part of one multilayer film has at least one region not superpositioned on the structured part of the other multilayer film.

4. The personalizable document as claimed in claim 1, further comprising an opaque structure layer, with a thickness between 50 μm and 400 μm, the personalizable layer and the multilayer films being arranged on the same side of the opaque structure layer.

5. A personalized security document comprising a personalizable document as claimed in claim 1, wherein an opaque personalization mask is written in the zone of transparency of the personalizable layer.

6. The personalized security document as claimed in claim 5, wherein the personalization mask has a variable opacity.

7. A personalizable document for the fabrication of a personalized security document designed to be authenticated in a spectral band of observation between 380 nm and 780 nm, comprising:

a layer personalizable by contact-free writing of an opaque personalization mask, wherein the personalizable layer has a thickness between 50 μm and 400 μm, is transparent in the spectral band of observation in at least one zone of transparency, and comprises additives able to become opaque under laser light;

a first multilayer film arranged on a first side of the personalizable layer, and covering at least part of the zone of transparency, the first multilayer film comprising a layer of high index of refraction encapsulated between two layers of low index of refraction, and structured on at least part of its surface to form a first subwavelength grating characterized by a first grating vector, such that the first multilayer film acts in zero order like a wavelength subtractive filter; and a second multilayer film arranged on a second side of the personalizable layer, opposite the first side, and covering at least part of the zone of transparency, the second multilayer film comprising a layer of high index of refraction encapsulated between two layers of low index of refraction, and structured on at least part of its surface to form a second subwavelength grating characterized by a second grating vector, such that the second multilayer film acts in zero order like a wavelength subtractive filter, the first and second gratings being at least partly superpositioned, wherein the first and second grating vectors have parallel directions and different norms.

8. A personalizable document for the fabrication of a personalized security document designed to be authenticated in a spectral band of observation between 380 nm and 780 nm, comprising:

a layer personalizable by contact-free writing of an opaque personalization mask, wherein the personalizable layer has a thickness between 50 μm and 400 μm, is transparent in the spectral band of observation in at least one zone of transparency, and comprises additives able to become opaque under laser light;

a first multilayer film arranged on a first side of the personalizable layer, and covering at least part of the zone of transparency, the first multilayer film comprising a layer of high index of refraction encapsulated between two layers of low index of refraction, and structured on at least part of its surface to form a first subwavelength grating characterized by a first grating vector, such that the first multilayer film acts in zero order like a wavelength subtractive filter;

a second multilayer film arranged on a second side of the personalizable layer, opposite the first side, and covering at least part of the zone of transparency, the second multilayer film comprising a layer of high index of refraction encapsulated between two layers of low index of refraction, and structured on at least part of its surface to form a second subwavelength grating characterized by a second grating vector, such that the second multilayer film acts in zero order like a wavelength subtractive filter, the first and second gratings being at least partly superpositioned, and an assemblage of structure layers, with thicknesses between 50 μm and 400 μm, said structure layers being transparent in the spectral band of observation at least in the area of the zone of transparency.

9. A method of fabrication of a personalized security document designed to be authenticated in a spectral band of observation between 380 nm and 780 nm, comprising:

providing a layer, personalizable by contact-free writing of an opaque personalization mask, wherein the personalizable layer has a thickness between 50 μm and 400 μm, is transparent in a least one zone of transparency in the spectral band of observation, and comprises additives able to become opaque under laser light, arranging, on each of the opposite sides of said layer of a first multilayer film and a second multilayer film, such that:

each of the first and second multilayer films comprises a layer of high index of refraction encapsulated between two layers of low index of refraction, structured on at least a portion of its surface to form respectively a first and a second subwavelength grating, such that the first and second multilayer films act in the zero order as wavelength subtractive filters, the first and second multilayer films are arranged in the area of the zone of transparency of the personalizable layer such that the first and second gratings are at least partly superpositioned;

contact-free writing by laser engraving of an opaque personalization mask in the zone of transparency of the personalizable layer, wherein the first and second gratings have orthogonal directions.

10. The method as claimed in claim 9, comprising the fabrication of at least one of said multilayer films on a structure layer, wherein said structure layer has a thickness between 50 μm and 400 μm, said fabrication comprising:

depositing on a support layer of a first layer of low index, the structured layer of high index and a second layer of low index, transferring of the stack of layers so obtained onto the structure layer, removing of the support layer.

11. A method of fabrication of a personalized security document designed to be authenticated in a spectral band of observation between 380 nm and 780 nm, comprising:

providing a layer, personalizable by contact-free writing of an opaque personalization mask, wherein the personalizable layer has a thickness between 50 μm and 400 μm, is transparent in a least one zone of transparency in the spectral band of observation, and comprises additives able to become opaque under laser light, arranging, on each of the opposite sides of said layer of a first multilayer film and a second multilayer film, such that:

each of the first and second multilayer films comprises a layer of high index of refraction encapsulated between two layers of low index of refraction, structured on at least a portion of its surface to form respectively a first and a second subwavelength grating, such that the first and second multilayer films act in the zero order as wavelength subtractive filters, the first and second multilayer films are arranged in the area of the zone of transparency of the personalizable layer such that the first and second gratings are at least partly superpositioned;

contact-free writing by laser engraving of an opaque personalization mask in the zone of transparency of the personalizable layer, and fabricating each of the multilayer films on a structure layer, wherein said structure layer has a thickness between 50 μm and 400 μm and is transparent at least in the area of the zone of transparency.

12. The method as claimed in claim 11, further comprising the arranging of said structure layers on either side of the personalizable layer.

13. The method as claimed in claim 11, wherein the fabrication of at least one of said multilayer films is done directly on the personalizable layer.

14. A method of fabrication of a personalized security document designed to be authenticated in a spectral band of observation between 380 nm and 780 nm, comprising:

providing a layer, personalizable by contact-free writing of an opaque personalization mask, wherein the personalizable layer has a thickness between 50 μm and 400 μm, is transparent in a least one zone of transparency in the spectral band of observation, and comprises additives able to become opaque under laser light, arranging, on each of the opposite sides of said layer of a first multilayer film and a second multilayer film, such that:

each of the first and second multilayer films comprises a layer of high index of refraction encapsulated between two layers of low index of refraction, structured on at least a portion of its surface to form respectively a first and a second subwavelength grating, such that the first and second multilayer films act in the zero order as wavelength subtractive filters, the first and second multilayer films are arranged in the area of the zone of transparency of the personalizable layer such that the first and second gratings are at least partly superpositioned;

contact-free writing by laser engraving of an opaque personalization mask in the zone of transparency of the personalizable layer, wherein the first and second gratings have parallel directions and different norms.

* * * * *